US012281834B2

(12) United States Patent
Ryu et al.

(10) Patent No.: US 12,281,834 B2
(45) Date of Patent: Apr. 22, 2025

(54) REFRIGERATOR FAN COVER WITH ACTIVE LOUVERS AND METHOD OF OPERATION

(71) Applicant: Haier US Appliance Solutions, Inc., Wilmington, DE (US)

(72) Inventors: Choon Jae Ryu, Prospect, KY (US); Stephanos Kyriacou, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 101 days.

(21) Appl. No.: 18/188,051

(22) Filed: Mar. 22, 2023

(65) Prior Publication Data

US 2024/0318891 A1 Sep. 26, 2024

(51) Int. Cl.
*F25D 17/04* (2006.01)
*F25D 17/06* (2006.01)

(52) U.S. Cl.
CPC ..... *F25D 17/045* (2013.01); *F25D 17/065* (2013.01); *F25D 17/067* (2013.01); *F25D 2317/0666* (2013.01)

(58) Field of Classification Search
CPC .... F25D 17/045; F25D 17/065; F25D 17/067; F25D 2317/0665
See application file for complete search history.

(56) References Cited

U.S. PATENT DOCUMENTS

| | | | | |
|---|---|---|---|---|
| 5,970,736 | A | 10/1999 | Gong et al. | |
| 5,987,904 | A * | 11/1999 | Kim | F25D 17/065 62/131 |
| 6,014,865 | A | 1/2000 | Kim et al. | |
| 2004/0144128 | A1 * | 7/2004 | Junge | F25D 17/045 62/275 |

FOREIGN PATENT DOCUMENTS

| | | | | |
|---|---|---|---|---|
| CN | 110274423 | A * | 9/2019 | |
| CN | 110274423 | B | 8/2021 | |
| JP | H01217174 | A * | 8/1989 | |
| JP | H0223962 | A * | 1/1990 | |
| JP | H02233962 | A * | 9/1990 | |
| JP | H0367885 | B2 * | 3/1991 | |
| JP | H0367885 | A * | 7/1991 | |
| JP | 2651371 | B2 * | 9/1997 | |
| JP | 2006300472 | A | 11/2006 | |
| JP | 5109842 | B2 * | 12/2012 | |
| KR | 0153496 | B1 * | 1/1999 | |
| KR | 19990027381 | A * | 4/1999 | |
| KR | 19990027381 | U * | 4/1999 | |
| KR | 200264516 | Y1 | 2/2002 | |
| KR | 20120072774 | A * | 7/2012 | |
| KR | 20150085214 | A * | 7/2015 | F24F 11/72 |

* cited by examiner

*Primary Examiner* — Emmanuel E Duke
(74) *Attorney, Agent, or Firm* — Dority & Manning, P.A.

(57) ABSTRACT

A refrigerator appliance including a sealed cooling system with an evaporator in a frozen food storage chamber is presented. The evaporator includes a cover with movable louvers to allow chilled air to flow to the frozen food storage chamber in a first position and to block the flow in a second position, and a method of operation for such a refrigerator appliance.

16 Claims, 10 Drawing Sheets

REFRIGERATOR FAN COVER WITH ACTIVE LOUVERS AND METHOD OF OPERATION

FIELD OF THE INVENTION

The present disclosure relates generally to a refrigerator appliance, more particularly to a refrigerator with two chilled chambers and one evaporator.

BACKGROUND OF THE INVENTION

Refrigerator appliances generally include a cabinet with one or more chilled chambers, e.g., a fresh food chamber, a freezer chamber, or the like, to maintain foods at temperatures lower than ambient. The chambers of a refrigerator are typically chilled by a sealed cooling system to transfer heat from the chilled chambers to the ambient environment. The cooling system typically comprises a compressor, a condenser, an evaporator, one or more fans, and a working fluid or refrigerant.

Typical cooling systems for refrigerator appliances place the evaporator in the freezer chamber with a fan to urge an air flow over the evaporator, chilling the air flow to maintain the low temperature in the freezer chamber. A fan cover with fixed openings is commonly placed over the evaporator and fan to limit the flow of chilled air in the freezer chamber and direct some chilled air flow to the fresh food chamber to maintain a reduced temperature. Typical cooling systems provide chilled air to the chambers without consideration of the cooling needs of the particular chambers. Such systems can result in improperly chilled chambers and customer dissatisfaction. Accordingly, improvements to the supply of chilled air to refrigerator appliance chambers would be beneficial.

BRIEF DESCRIPTION OF THE INVENTION

Aspects and advantages of the invention will be set forth in part in the following description, may be apparent from the description, or may be learned through practice of the invention.

In one exemplary aspect, a refrigerator appliance comprises a cabinet defining fresh food and frozen food storage chambers, a sealed cooling system comprising a compressor, an evaporator, and a fan, the evaporator and fan are disposed in the frozen food storage chamber. A cover is disposed over the evaporator and fan, the cover defining one or more open areas with louvers positioned in the one or more of the open areas in the fan cover. The louvers are selectively movable between a first position to allow fluid communication between the evaporator fan and the frozen food storage chamber through the one or more open areas and a second position in which the louvers cooperate to block fluid communication between the evaporator fan and the frozen food storage chamber through the one or more open areas.

In another exemplary aspect, a method of operating a refrigerator appliance is disclosed. The refrigerator appliance comprises a cabinet defining a fresh food storage chamber and a frozen food storage chamber, a sealed cooling system comprising compressor, an evaporator, and an evaporator fan, the evaporator and evaporator fan are disposed in the frozen food storage chamber. A cover is disposed over the evaporator and evaporator fan, the cover defining one or more open areas and partially defining a chilled air plenum. Louvers are positioned in the one or more open areas, the louvers selectively movable between a first position and a second position. A supply duct fluidly couples the chilled air plenum with the fresh food storage chamber, and a damper is fluidly coupled with the supply duct. The method comprises the steps of starting the cooling cycle to distribute a refrigerant through the sealed cooling system, determining a temperature in the fresh food storage chamber and determining a temperature in the frozen food storage chamber. The method selects a mode of operation for the cooling cycle from a first mode, a second mode, and a third mode, the mode of operation based on the temperature in the fresh food storage chamber and the temperature in the frozen food storage chamber. The first mode comprises closing the louvers and opening the damper, the second mode comprises opening the louvers and closing the damper, and the third mode comprises opening the louvers and opening the damper. The method operates the cooling cycle according to the selected mode and stops the cooling cycle when the temperature in the fresh food storage chamber is less than the prescribed minimum temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
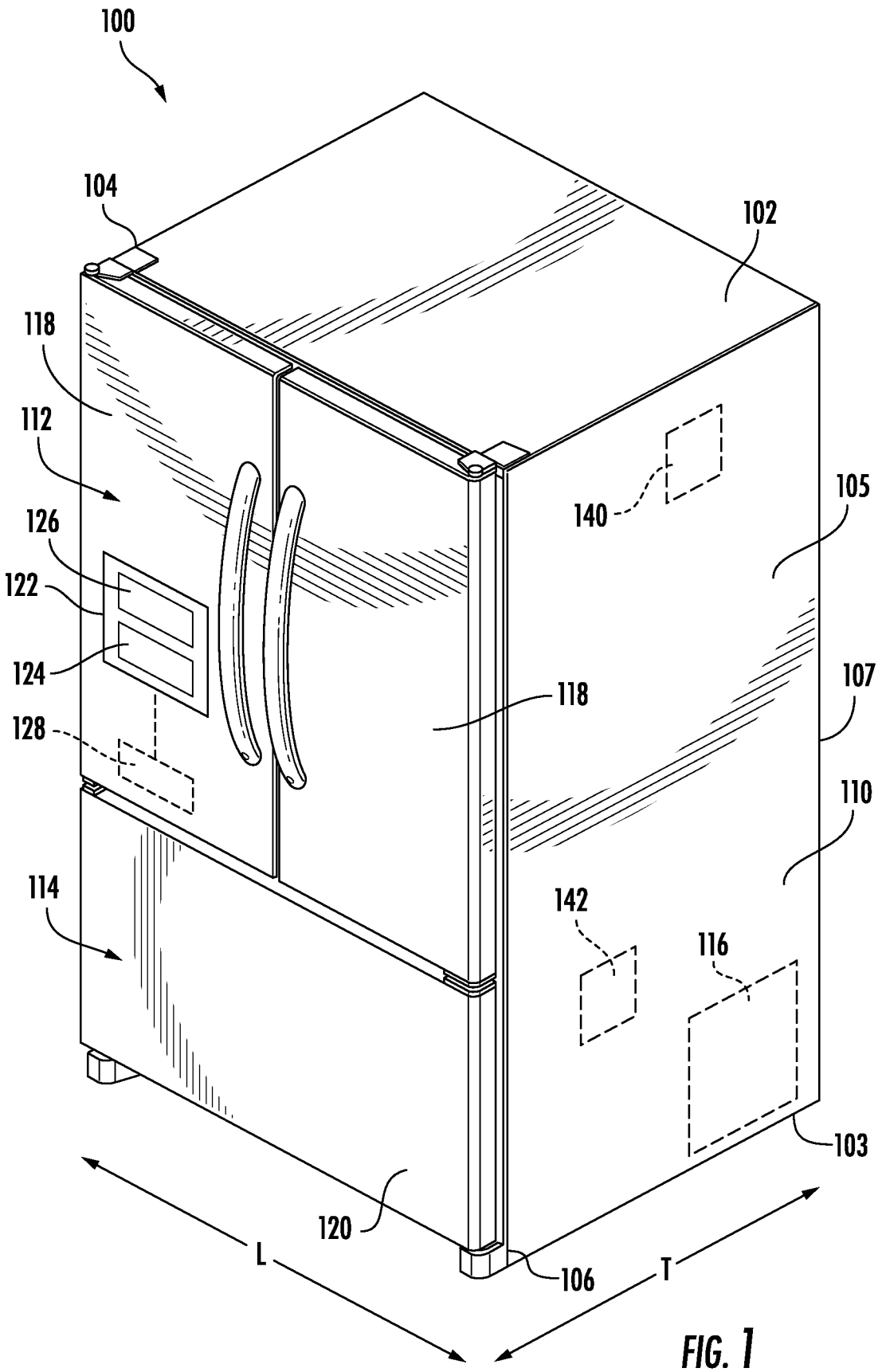
FIG. 1 provides a perspective view of a refrigerator appliance in accordance with an embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Turning to the figures, FIG. 1 provides a front view of an exemplary refrigerator appliance 100 according to an exemplary embodiment of the present disclosure. Refrigerator appliance 100 extends between a top 102 and a bottom 103 along a vertical direction V. Refrigerator appliance 100 also extends between a first side 104 and a second side 105 along a lateral direction L. Further, refrigerator appliance 100 extends between a front portion 106 and a back portion 107 along a transverse direction T, which is a direction orthogonal to the vertical direction V and the lateral direction L. Vertical direction V, lateral direction L, and transverse direction T are mutually perpendicular and form an orthogonal direction system.

Figure 2:
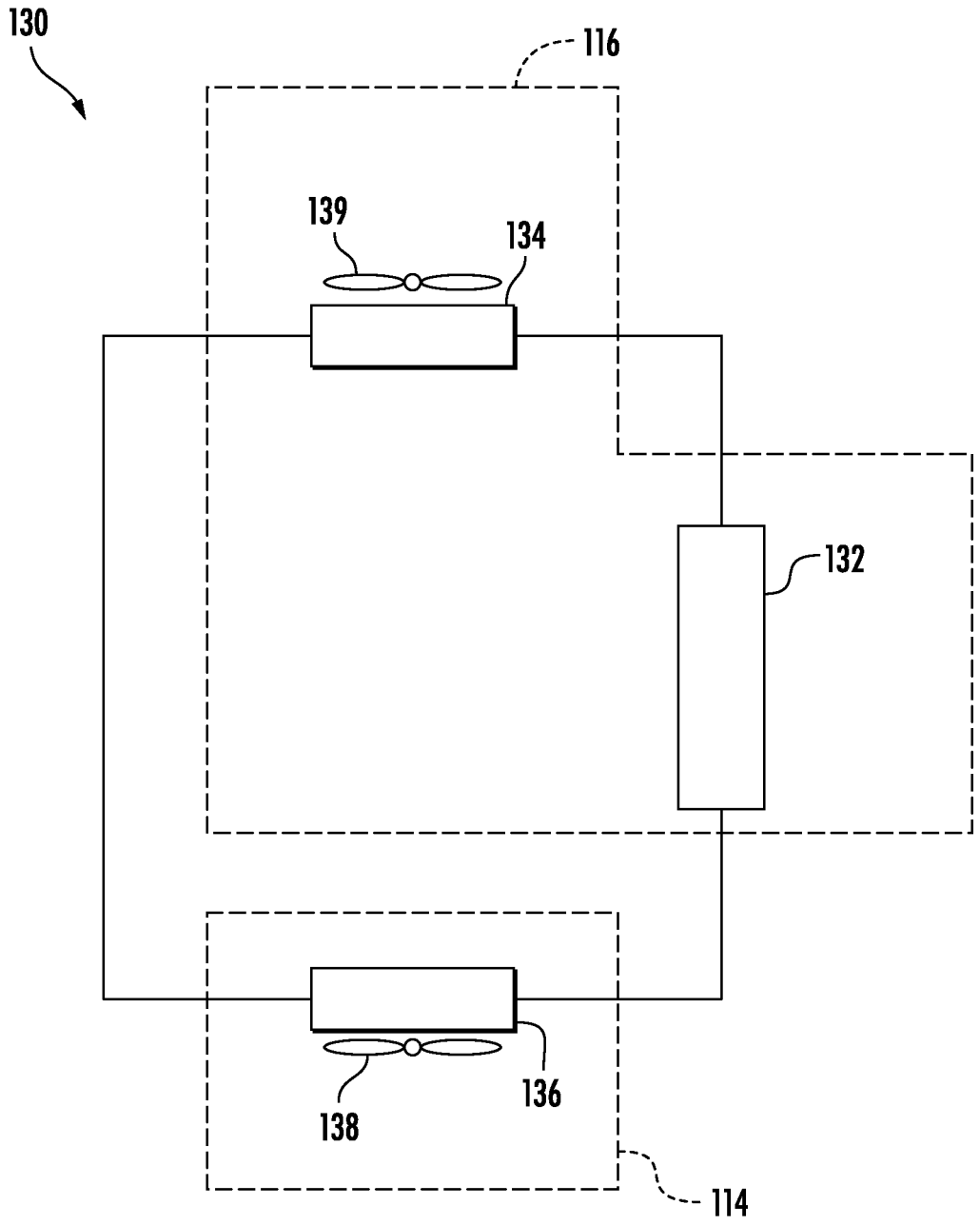
FIG. 2 provides a schematic representation of a sealed cooling system in accordance with an embodiment of the present disclosure.

According to embodiments of the present disclosure, the refrigerator appliance 100 includes a cabinet 110 defining a fresh food storage chamber 112, a frozen food storage chamber 114 below the fresh food storage chamber 112, and a mechanical compartment 116 for receipt of some components of a sealed cooling system 130. The sealed cooling system 130 is shown schematically in FIG. 2 and comprises a compressor 132, a condenser 134, an evaporator 136, evaporator fan 138, and condenser fan 139 with at least the evaporator 136 and evaporator fan 138 disposed in the frozen food storage chamber 114. At least the condenser and the compressor are received in the mechanical compartment 116. A cover 144 (more thoroughly described below) is disposed over at least the evaporator 136 and evaporator fan 138 in the frozen food storage chamber 114 to facilitate control of cooling air, protect the mechanical components from damage, as well as to protect a user from inadvertent contact with sharp, moving, or dangerously cold components.

Fresh food storage chamber doors, refrigerator doors 118, are rotatably hinged to an edge of cabinet 110 for accessing fresh food chamber 112. For example, upper and lower hinges (not shown) may couple refrigerator doors 118 to cabinet 110. When refrigerator doors 118 are configured as illustrated in FIG. 1, the door arrangement is sometimes referred to as a "French door" configuration. Access to frozen food storage chamber 114 may be provided through freezer door 120 positioned below refrigerator doors 118. In the exemplary embodiment of FIG. 1, freezer door 120 is coupled to a freezer drawer (not shown) slidably coupled to cabinet 110 within frozen food storage chamber 114. Because the frozen food storage chamber 114 is positioned below the fresh food chamber 112, refrigerator appliance 100 is generally referred to as a bottom mount freezer refrigerator.

Refrigerator appliance 100 may include a control panel 122 that may represent a general-purpose Input/Output ("GPIO") device or functional block for appliance 100. In some embodiments, control panel 122 may include or be in operative communication with one or more user input devices 124, such as one or more of a variety of digital, analog, electrical, mechanical, or electro-mechanical input devices including rotary dials, control knobs, push buttons, toggle switches, selector switches, and touch pads. Additionally, refrigerator appliance 100 may include a display 126, such as a digital or analog display device generally configured to provide visual feedback regarding the operation of refrigerator appliance 100. For example, display 126 may be provided on control panel 122 and may include one or more status lights, screens, or visible indicators. According to exemplary embodiments, user input devices 124 and display 126 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Refrigerator appliance 100 may further include or be in operative communication with a processing device or a controller 128 that may be generally configured to facilitate appliance operation. Controller 128 may include operating instructions or algorithms useful in determining the operation of various systems. In this regard, control panel 122, user input devices 124, temperature sensors 140, 142, display 126, and other sensor devices such as humidity sensors, timers, and the like may be in communication with controller 128 such that controller 128 may receive control inputs from user input devices 124, may display information using display 126, and may otherwise regulate operation of refrigerator appliance 100. For example, signals generated by controller 128 may operate refrigerator appliance 100, including any or all system components, subsystems, or interconnected devices, in response to the position of user input devices 124 and other control commands. Control panel 122 and other components of appliance 100 may be in communication with controller 128 via, for example, one or more signal lines or shared communication busses. In this manner, Input/Output ("I/O") signals may be routed between controller 128 and various operational components of refrigerator appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 128 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 128 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 128 may be operable to execute programming instructions or algorithms associated with an operating cycle of refrigerator appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 128 as disclosed herein is capable of and may be operable to perform any methods, method steps, or portions of methods as disclosed herein. For example, in some embodiments, methods disclosed herein may be embodied in programming instructions stored in the memory and executed by controller 128.

The memory devices may also store data that can be retrieved, manipulated, created, or stored by the one or more processors or portions of controller 128. The data can include, for instance, data to facilitate performance of methods described herein. The data can be stored locally (e.g., on controller 128) in one or more databases and/or may be split up so that the data is stored in multiple locations.

Refrigerator appliance 100 may further include timers, clocks, or sensors, such as temperature sensors or humidity sensors disposed in the cabinet 110 and inoperative communication with controller 128. For example, temperature sensor 140 may be located in the fresh food chamber 112 to provide feedback to controller 128 related to the temperature condition in the fresh food chamber 112. Similarly, temperature sensor 142 may be located in the frozen food storage chamber 114 to provide similar feedback to the controller 128 regarding temperature conditions in the frozen food storage chamber 114. Feedback provided by the temperature sensors 140, 142 may be processed by controller 128 using appropriate algorithms to determine operation of various components of the refrigerator appliance 100. For example, the algorithms may use the information from the temperature sensors 140, 142 to determine if a chamber is at a prescribed maximum temperature at which point chilled air is to be provided to that chamber or that the chamber is at or, in some cases, below a prescribed minimum temperature and the supply of chilled air should be stopped.

As used herein, "temperature sensor" or the equivalent is intended to refer to any suitable type of temperature measuring system or device positioned at any suitable location for measuring the desired temperature. Thus, for example, temperature sensors 140, 142 may each be any suitable type of temperature sensor, such as a thermistor, a thermocouple, a resistance temperature detector, a semiconductor-based integrated circuit temperature sensor, etc. In addition, temperature sensors 140, 142 may be positioned at any suitable location within the fresh food storage or frozen food storage chambers 112, 114, respectively, and may output a signal, such as a voltage, to a controller that is proportional to and/or indicative of the temperature being measured. Although exemplary positioning of temperature sensors is described herein, it should be appreciated that refrigerator appliance 100 may include any other suitable number, type, and position of temperature, humidity, and/or other sensors according to alternative embodiments.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 128 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 128 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 128 may be operable to execute programming instructions or micro-control code associated with an operating cycle of appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 128 as disclosed herein is capable of and may be operable to perform any methods, method steps, or portions of methods as disclosed herein. For example, in some embodiments, methods disclosed herein may be embodied in programming instructions stored in the memory and executed by controller 128.

The memory devices may also store data that can be retrieved, manipulated, created, or stored by the one or more processors or portions of controller 128. The data can include, for instance, data to facilitate performance of methods described herein. The data can be stored locally (e.g., on controller 128) in one or more databases and/or may be split up so that the data is stored in multiple locations. In addition, or alternatively, the one or more database(s) can be connected to controller 128 through any suitable network(s), such as through a high bandwidth local area network (LAN) or wide area network (WAN). In this regard, for example, controller 128 may further include a communication module or interface that may be used to communicate with one or more other component(s) of appliance 100, controller 128, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Figure 3:
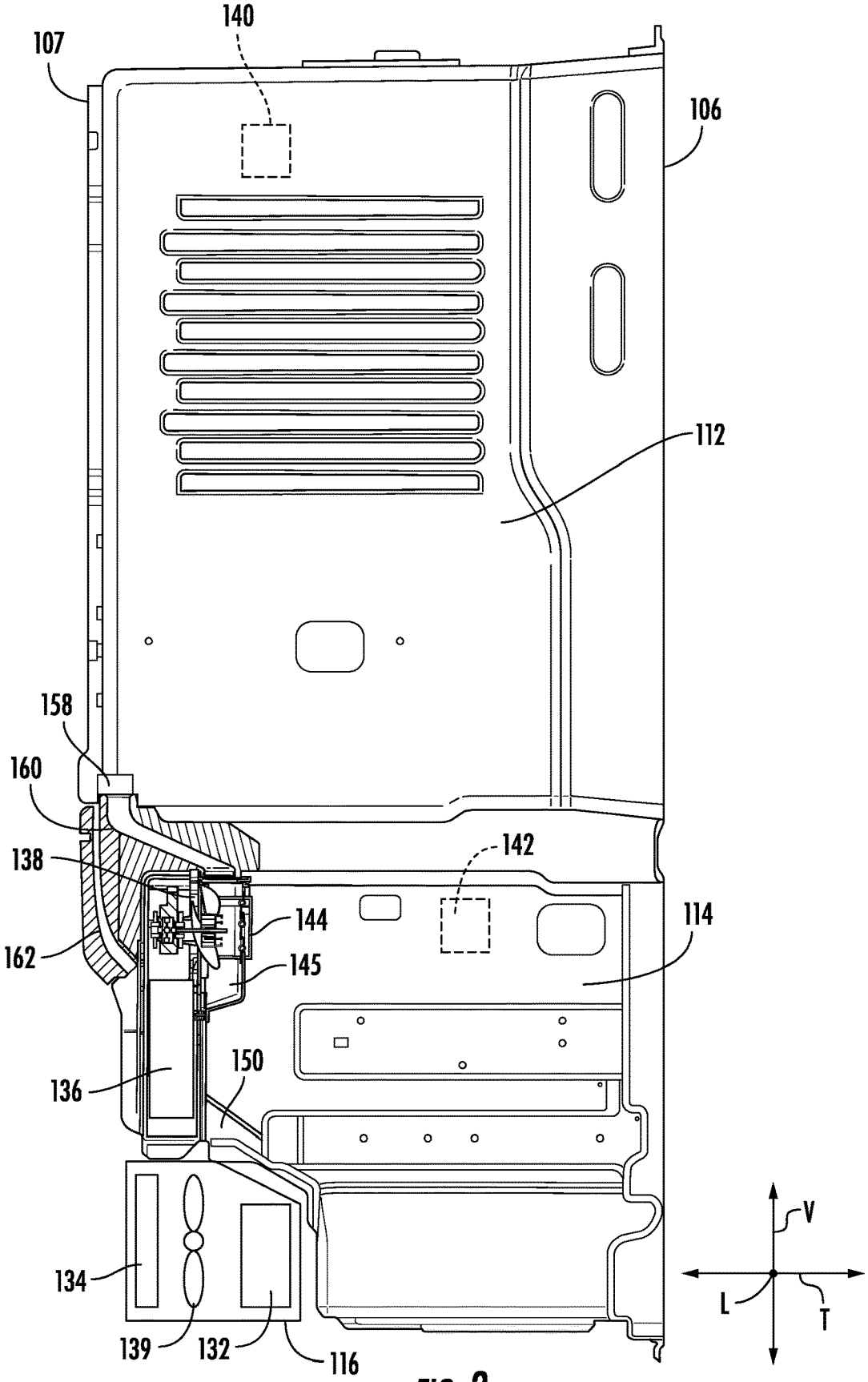
FIG. 3 provides a partial side view of internal components of the refrigerator appliance of FIG. 1.

FIG. 3 is representative of a side view of internal components of refrigerator appliance 100, as viewed from first side 104. For clarity, the cabinet 110 and other detail parts are not shown. As illustrated, mechanical compartment 116 includes compressor 132, condenser 134, and condenser fan 139. Evaporator 136 and evaporator fan 134 are located within the frozen food storage chamber 114. Fluid communication conduits placing compressor 132, condenser 134 and evaporator 136 in fluid communication with each other are not shown for clarity. Control communication between controller 128 and cooling system 130 are also not shown.

Cover 144 is disposed over evaporator fan 138 and evaporator 136 in the frozen food storage chamber 114, separating them from the chamber 114. The space occupied by the evaporator 136 and evaporator fan 138, bounded by the cover 144 and a portion of the frozen food storage chamber, is a chilled air plenum 145 from which chilled air is distributed, for example, to the fresh food storage chamber 112 or the frozen food storage chamber 114.

Figure 4:
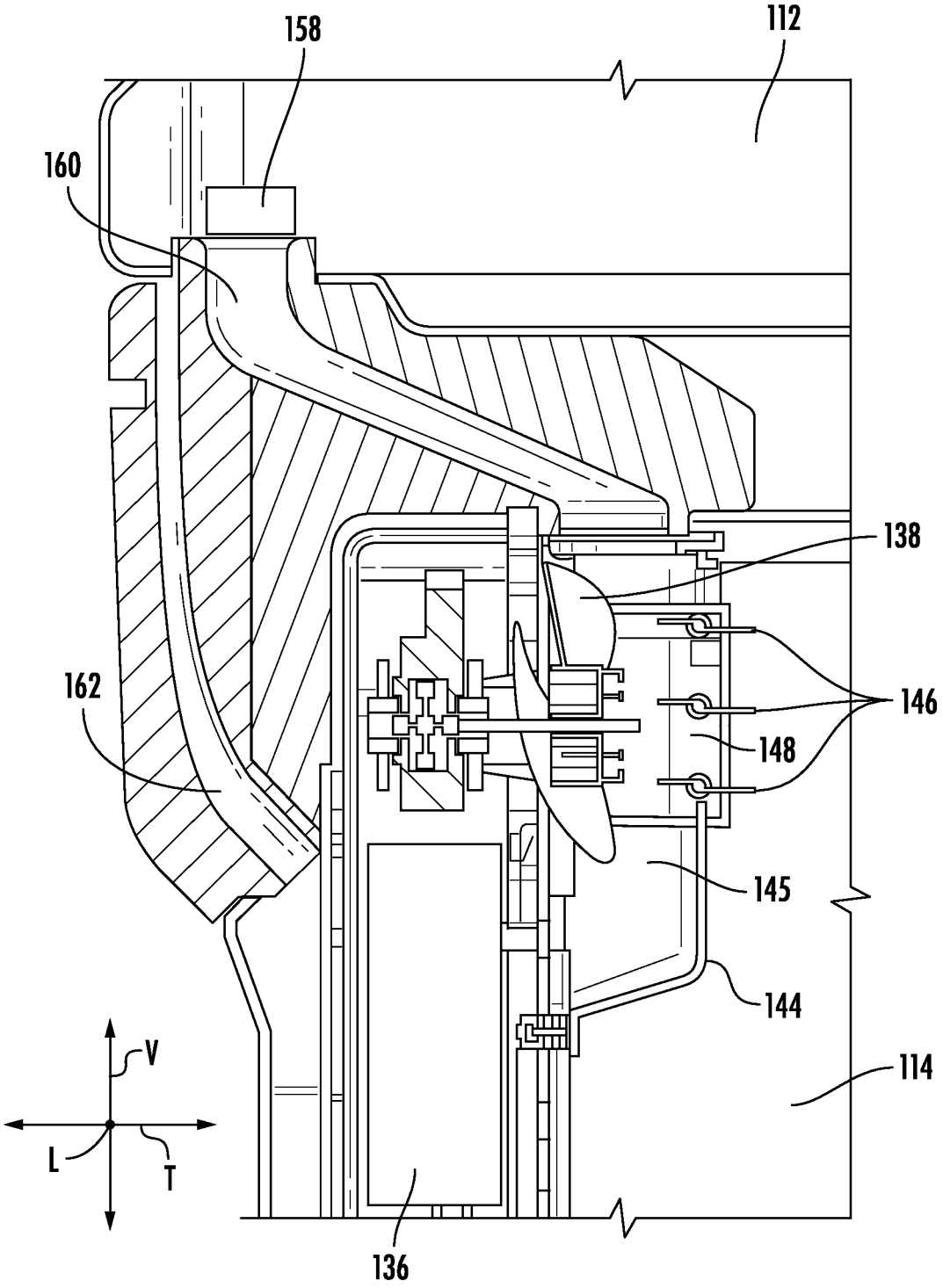
FIG. 4 provides an enlarged close-up of a portion of FIG. 3 in a first configuration.
Figure 5:
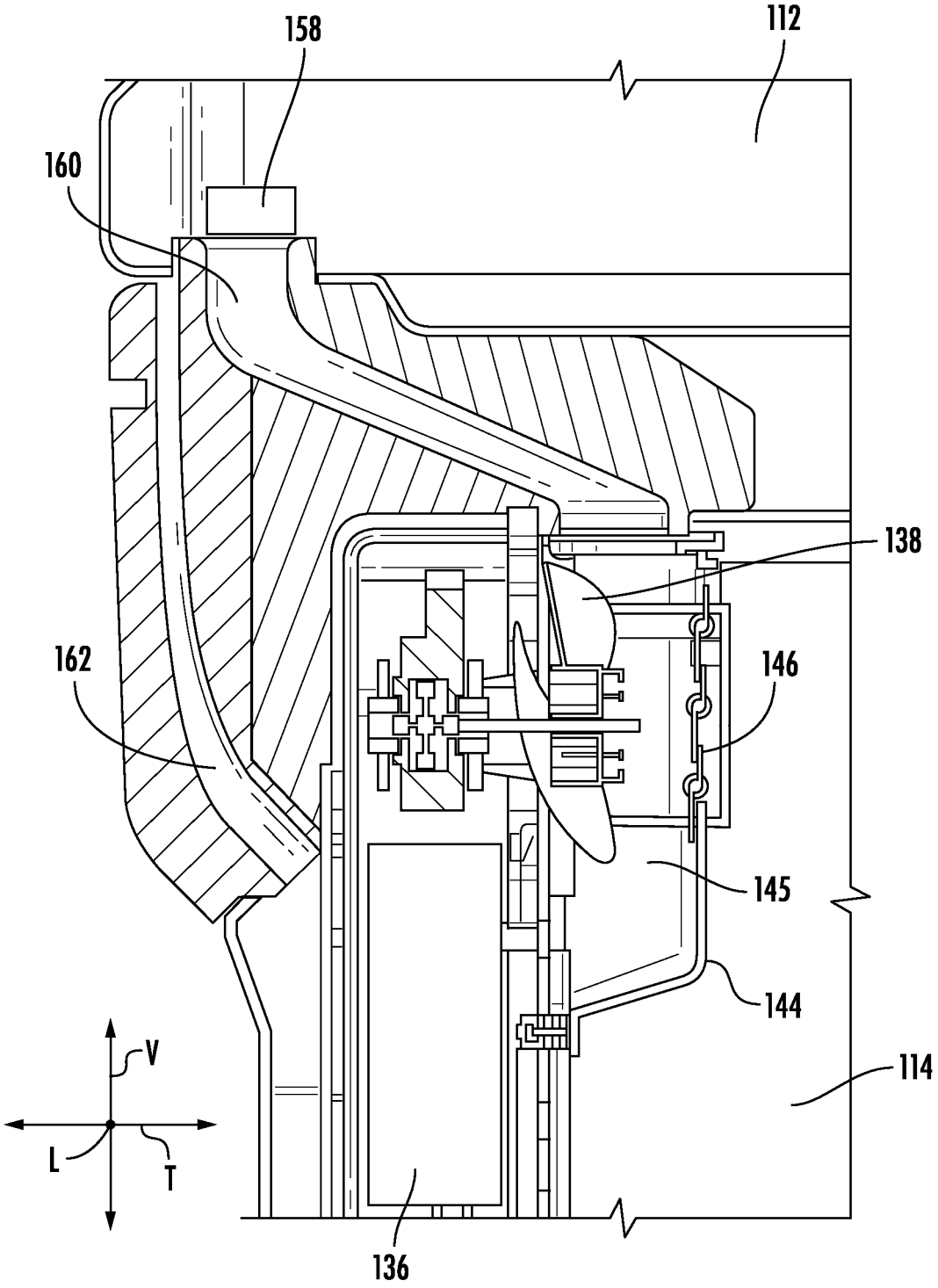
FIG. 5 provides an enlarged close-up of a portion of FIG. 3 in a second configuration.
Figure 6:
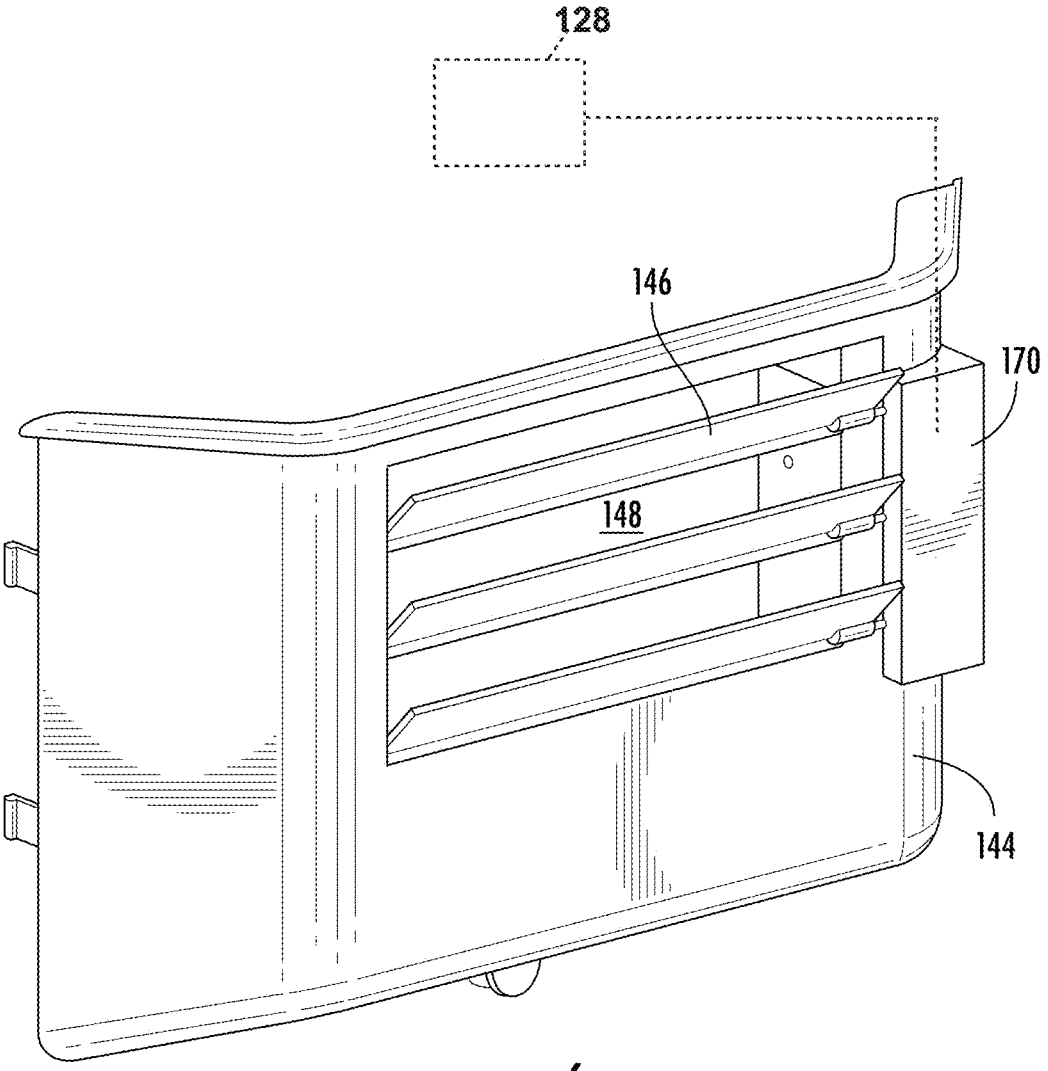
FIG. 6 provides a perspective view of a cover in accordance with an embodiment of the present disclosure.

As shown in FIGS. 4 and 6, selective fluid communication between the fan 138 and evaporator 136 (i.e., the chilled air plenum) and the frozen food storage chamber 114 is established through one or more open areas 148 defined by the cover 144. The fluid communication is controlled by active louvers, louvers 146, positioned on the fan cover 144 and in the open areas 148 to allow, partially block, or block fluid communication through the one or more open areas 148. Louvers, as used herein, is intended to include slanted or vertical strips or slats movable in rotation or translation, including linear displacement in any plane. The louvers 146 are active in that they are movable between at least a first position (FIG. 4) allowing fluid communication and a second position (FIG. 5) in which the louvers 146 cooperate to impede or block communication. The movement of the louvers 146 is in response to commands, for example commands from controller 128. Louvers 146 may also be movable to intermediate positions between the first and second positions, metering the fluid communication between the chilled air plenum 145 and the frozen food storage chamber 114. Two positions of louvers 146 are shown in FIGS. 4 and 5 which are enlarged close-up views of the evaporator 136, fan 138, and cover 144 in frozen food chamber 114.

When fluid communication is provided as illustrated in FIG. 4, representative louvers 146 are mechanically urged to align with the direction of air flow as induced by evaporator fan 138, i.e., generally horizontal, or parallel to the L-T plane. Fan 138 draws air from the frozen food storage chamber 114 through freezer return duct 150, urges the air to flow through evaporator 136 to give up heat and into the chilled air plenum 145, and then the chilled air is returned to the frozen food storage chamber 114 through the louvered opening in the cover 144.

The condenser 136 and fan 138 also provide chilled air to the fresh food storage chamber 112 in a controlled fashion. As can be seen in FIGS. 3-5, chilled air plenum 145 is fluidly coupled with fresh food storage chamber 112 via supply duct 160 and refrigerator return duct 162. The supply of chilled air to the fresh food storage chamber 112 is controlled by damper 158 fluidly coupled to the supply duct 160 at the fresh food storage chamber 112 as illustrated. In other embodiments, the damper 158 is fluidly coupled to the chilled air plenum 145 or along the length of the supply duct 160. The damper 158 may be placed in a first (open) position allowing flow or a second (closed) position blocking flow from the duct 160. In some embodiments, the damper 158 may be placed in intermediate positions, between the first and second positions, in which flow is partially restricted rather than fully allowed or fully blocked.

Damper 158 is operable by controller 128 to control chilled air flow from refrigerator supply duct 160 to the fresh food storage chamber 112. The flow to the fresh food storage chamber 112 is also influenced by the position of the louvers 146 in cover 144. When louvers 146 are in the second (closed) position of FIG. 5, substantially all of the air moved by evaporator fan 138 is available to the fresh food storage chamber 112, subject to damper 158 being in a first (open) position. When damper 158 is open, evaporator fan 138 energized, and louvers 146 are closed, air from the fresh food storage chamber 112 is drawn through return duct 162 by evaporator fan 138, passes across the evaporator 136 to give up heat, flows into the chilled air plenum 145, and is returned to the fresh food storage chamber 112 via the fresh food chamber supply duct 160.

Accordingly, the disclosed system can supply chilled air in a number of configurations. In one configuration, when the louvers 146 are open (FIG. 4) and the damper 158 is closed, substantially all of the chilled air moved by evaporator fan 138 will be provided to the frozen food storage chamber 114. In another configuration, when the damper 158 is open and the louvers 146 are closed (FIG. 5), substantially all of the chilled air will be provided to the fresh food storage chamber 112. In yet another configuration, chilled air can be provided to both the fresh food storage chamber 112 and the frozen food storage area 114 when both the damper 158 and the louvers 146 are open. By adjusting the damper 158 and louvers 146 to intermediate positions (i.e., not fully open or fully closed), the distribution of chilled air to each of the fresh food storage chamber 112 and the frozen food storage chamber 114 can be adjusted as needed.

The illustrative cover 144 has been described and shown as comprising a series of louvers 146 across one or more open areas 148 formed in and defined by the cover 144. This embodiment can be seen for example in FIG. 6 with the louvers 146 in an intermediate position. The cover 144 has a number of louvers 146 (three shown) mechanically coupled to a drive unit 170. The drive unit 170 rotates the louvers 146 in a coordinated manner, either in unison or individually, between an open position (FIG. 4) and a closed position (FIG. 5) passing through many intermediate positions that may be employed in embodiments of this disclosure to adjust the flow of chilled air to the chambers as needed. The drive unit 170 is operatively coupled to the controller 128 and operates in response to commands, for example commands from the controller 128.

Figure 7:
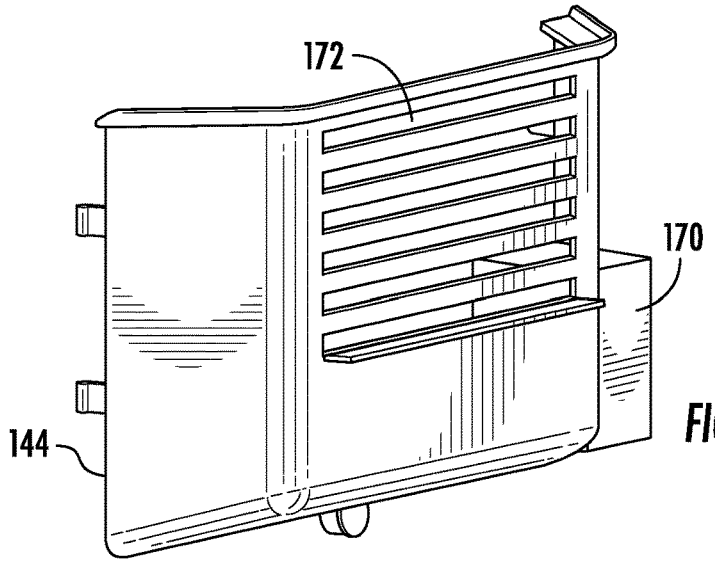
FIG. 7 provides a perspective view of a cover in accordance with an embodiment of the present disclosure in a first configuration.
Figure 8:
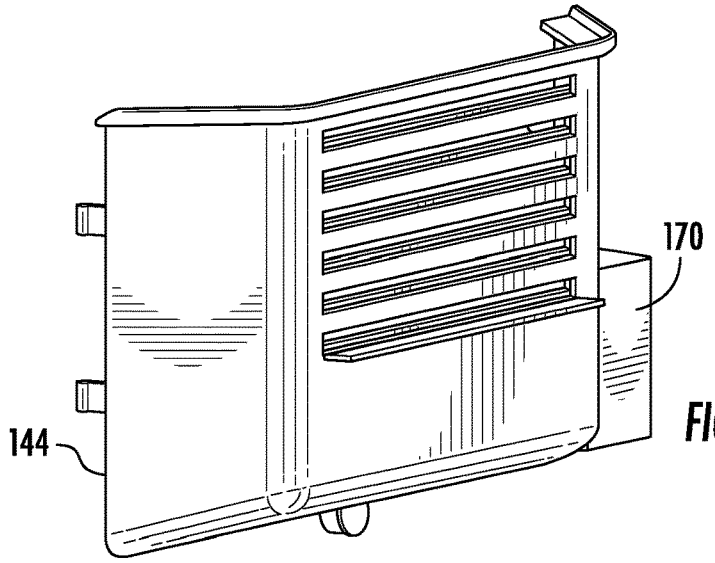
FIG. 8 provides a perspective view of a cover in accordance with an embodiment of the present disclosure in a second configuration.
Figure 9:
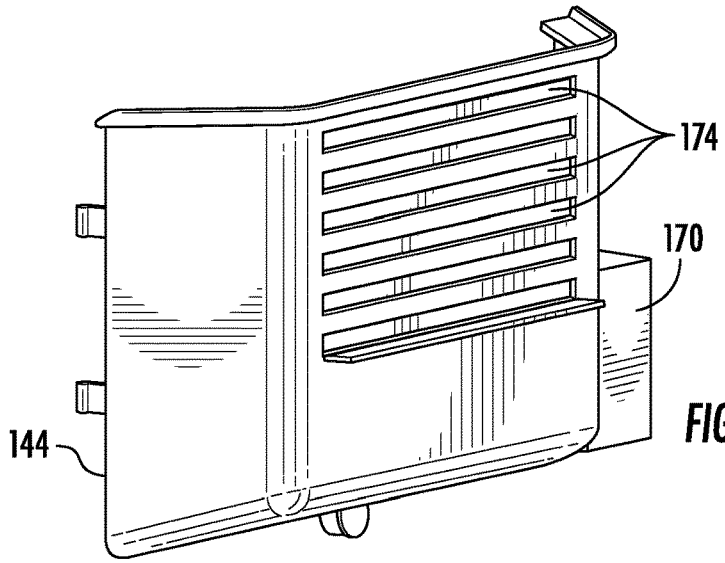
FIG. 9 provides a perspective view of a cover in accordance with an embodiment of the present disclosure in a third configuration.

In an alternate embodiment illustrated in FIGS. 7-9, selective material removal from the cover 144 defines one or more linear openings 172 (a series of six shown). A set of louvers, slats 174 (six shown) is provided, the slats 174 movable in a direction parallel to the plane of the linear openings 172. The slats 174 are mechanically coupled to a drive unit 170 which raises and lowers the slats 174 in response to commands, for example commands sent from the controller 128 operatively coupled to the drive unit 170. The slats 174 may move individually or in unison. The commands may direct the drive unit 170 to displace the slats 174 sufficiently to substantially leave the linear openings 172 unobstructed or open (FIG. 7) for maximum fluid communication through the cover 144. Alternately, the command may direct the drive unit 170 to displace the slats 174 to partially obstruct the linear opening 172 as in FIG. 8 to reduce the fluid communication through the cover 144. In another manner, the command may be to displace the slats 174 to obstruct the linear opening 172 to substantially block any fluid communication through the cover 144 as in FIG. 9.

Now that the construction of a refrigerator fan cover with active louvers in accordance with this disclosure has been presented, exemplary methods 200, 300, and 400 of operating a refrigerator appliance will be described with reference to FIGS. 10, 11, and 12. In accordance with the present disclosure, there are three logic schemes for operating a refrigerator fan cover with active grill louvers 146. Within each of these logic schemes, three modes of operation (a normal mode for both the fresh food storage chamber 112 and the frozen food storage chamber 114, a demand mode for the fresh food storage chamber 112, and a demand mode for the frozen food storage chamber 114) are disclosed for each scheme depending on the thermal load in each chamber as determined by the temperature in each chamber. Data corresponding to characteristics for each mode may be predetermined and stored in a memory of controller 152.

The normal mode is called for during steady state operation of the refrigerator appliance 100, for example during periods when the thermal load is predictable and access to the chambers is infrequent. The normal mode corresponds to a predicted or anticipated thermal load in the fresh food storage chamber 112 and a predicted or anticipated thermal load in the frozen food storage chamber 114. Data for the normal mode may include a predetermined door open frequency, or a predetermined door open duration, for the refrigerator door 118 or freezer door 120. The normal mode data may also include a predicted or anticipated temperature change with respect to time. The data may include a mathematical representation of a temperature versus time graph in which the time is represented on the X-axis and temperature is represented on the Y-axis. As generally understood, the slope would be down to the right with the passage of time (i.e., a negative slope). In a normal mode, one of ordinary skill will recognize that the temperature in a chamber would be expected to decrease with the passage of time as heat energy transfers from a higher temperature region (ambient) to a lower temperature region (fresh and frozen food storage chambers 112, 114). The mathematical representation of this normal decrease in temperature with respect to time may be theoretically or empirically determined and stored in the controller 128. The mathematical representation may also be learned by the refrigerator appliance 100 from actual use.

The controller 128 may use one or more data items identified above (e.g., door open frequency, prolonged door opening, or temperature-time slope) at a value less than or equal to a prescribed value as an indicator of the presence of a normal thermal load, and respond with a normal operating mode for the identified chamber.

A demand mode is called for in response to a determined demand condition in a chamber 112, 114. A demand condition corresponds with a temperature in one or more of the fresh food storage chamber 112 and the frozen food storage chamber 114 in excess of a prescribed maximum temperature. For example, a demand condition exists in the fresh food storage chamber when the temperature in the fresh food chamber exceeds a first prescribed temperature (i.e., a maximum temperature for the fresh food chamber). Additionally, or alternatively, a demand condition exists in the frozen food storage chamber when the temperature in the frozen food chamber exceeds a second prescribed temperature (i.e., a maximum temperature for the frozen food chamber). Generally, the first prescribed temperature is less than the second prescribed temperature.

A demand condition can be the result of frequent opening of the refrigerator or freezer doors 118, 120, a prolonged period of the refrigerator door 118 or freezer door 120, or both, being in an open position, or receipt in one of the chambers 112, 114 of warm items relative to the temperature of the chamber 112, 114, or the like. Frequent opening of the refrigerator or freezer doors 118, 120 can mean a door opening frequency greater than a prescribed frequency (i.e., number of openings per time period). A prolonged opening of one or more doors 118, 120 can mean a door moved to an open orientation for a time period in excess of a prescribed time period. The controller 128 may use a temperature versus time slope as an indicator of the receipt of warm items (relative to the temperature of chambers 112, 114). For example, if the slope of a temperature versus time plot is greater (i.e., has a steeper negative slope) than a prescribed maximum, the controller 128 may use that information as an indicator that items have been placed in one or more chambers 112, 114 in sufficient quantity to negatively affect the prescribed chamber temperature profile. The controller may recognize the negative slope of the temperature-time plot in excess of a prescribed negative slope as an indicator that a demand condition exists.

Each logic scheme addresses the potential for one or more chambers 112, 114 having a high thermal load triggering a demand response. The controller may use one or more data items identified above (e.g., door open frequency, prolonged door opening, or temperature-time slope) in excess of a prescribed value as an indicator of the presence of a high thermal load, and therefore a demand condition, in an identified chamber. The controller 128 may then follow a predetermined course of action to resolve or correct the demand condition. A demand condition is resolved or corrected when the high thermal load is reduced as determined by the temperature being reduced to less than a prescribed maximum set point temperature for that chamber. Such set point temperature may be stored in the controller 128.

Each logic scheme and mode of operation is appropriate for a refrigerator appliance having fresh food storage chamber 112 and a frozen food storage chamber 114, each chamber 112, 114 having a temperature sensor, a sealed cooling system 130 with one evaporator 136, an evaporator fan cover 144 defining one or more open areas 148 and partially defining a chilled air plenum 145 with active louvers 146 positioned in the one or more open areas, a supply duct fluidly coupling the chilled air plenum with the fresh food storage area, and a damper fluidly coupled with the supply duct.

In the illustrative methods 200, 300, and 400, the following abbreviations are used for space saving and clarity: FF refers to the fresh food storage chamber 112; FZ refers to the frozen food storage chamber 114; MAX FF SET PT 252 is the prescribed maximum temperature for the fresh food storage chamber 112; MAX FZ SET PT 254 is the prescribed maximum temperature for the frozen food storage chamber 114; MIN FF SET PT 256 is the prescribed minimum temperature for the fresh food storage chamber 112; and MIN FZ SET PT 258 is the prescribed minimum temperature for the frozen food storage chamber 114. The temperature sensors 140, 142 continuously send signals to the controller 128 corresponding to the temperatures in the chambers 112, 114. The controller 128 continuously monitors the temperatures in the fresh and frozen food storage chambers 112, 114, respectively, throughout the cooling cycle. The controller 128 compares the temperatures with the various prescribed maximum and minimum temperatures for each chamber 112, 114.

Figure 10:
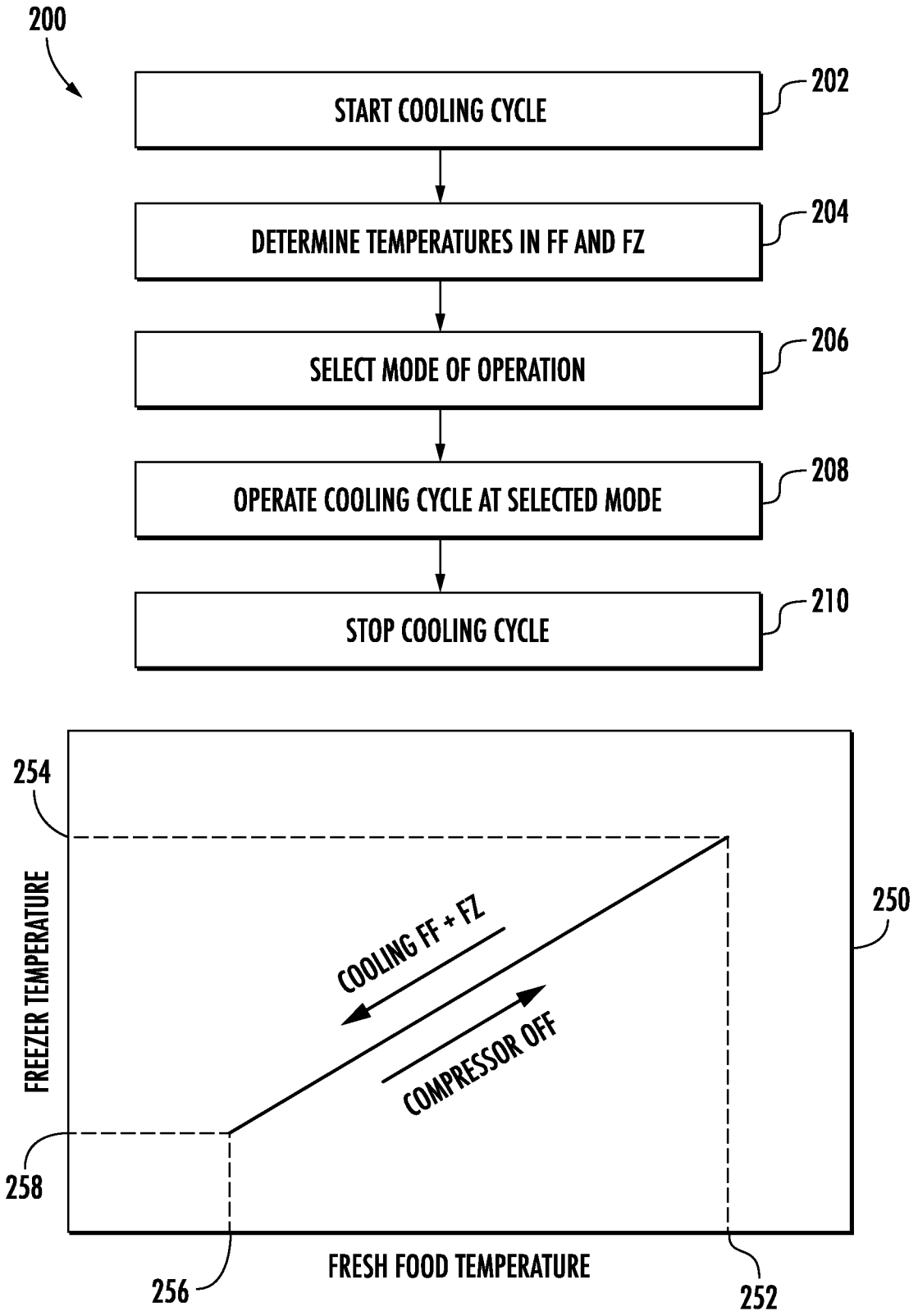
FIG. 10 illustrates a first method of operating a refrigerator appliance in a normal mode in accordance with an embodiment of the present disclosure.

Referring now to FIG. 10, the first logic scheme concurrently cools the fresh food storage chamber 112 and the frozen food storage chamber 114 in the normal mode.

The controller 128 receives a signal from each of the temperature sensors 140, 142 corresponding to the temperature in the fresh food storage chamber 112 and the frozen food storage chamber 114, respectively, to determine if a first demand condition exists in the fresh food storage chamber 112 or a second demand condition exists in the frozen food storage chamber 114. If found, the first and second demand conditions are corrected by providing cooling to the affected chamber, starting with the fresh food storage chamber 112, before moving to the frozen food storage chamber 114 if needed. After correcting the demand condition(s), the logic moves to the normal mode. This logic scheme is illustrated as method 200, beginning at step 202 at which the cooling cycle begins. To start the cooling cycle, the compressor 132 is energized to distribute the refrigerant and cycle the refrigerant through the sealed cooling system 130, e.g., the condenser 134 and evaporator 136. At a prescribed time (e.g., a prescribed delay after the compressor is energized), the evaporator fan 138 is energized to urge an air flow over the evaporator 136 to remove energy (heat) from the air flow and move the air into the chilled air plenum 145 and the method advances to 204.

At 204, the temperature of the fresh food storage chamber 112 and the frozen food storage chamber 114 are determined. The controller 128 receives a signal from the temperature sensors 140, 142 that corresponds to the temperatures in the fresh food storage chamber 112, and the frozen food storage chamber 114, respectively. From the signal, the controller 128 determines the chamber temperatures.

At 206, a mode of operation for the refrigerator appliance 100 is selected from a first mode, a second mode, and a third mode based on the temperatures determined in 204. The first mode corresponds to a temperature in the fresh food storage chamber 112 in excess of a prescribed maximum temperature 252 indicating a first demand condition exists in the fresh food storage chamber 112. In response, controller 128 instructs the drive unit 170 to close louvers 146 and that the damper 158 be open. In this configuration, all, or substantially all, of the air flow from the chilled air plenum 145 is directed to the fresh food storage chamber 112 until the first demand condition is corrected.

In the second mode of operation, the louvers 146 are opened and the damper 158 is closed in response to a detected temperature in the frozen food storage chamber in excess of a prescribed maximum temperature 254, indicating that a second demand condition exists. In this configuration, all, or substantially all, of the chilled air flow from the chilled air plenum 145, is directed to the frozen food storage chamber 114. This flow continues until the second demand condition in the frozen food storage chamber 114 no longer exists.

In the third mode of operation, the logic enacts a normal mode of operation. This mode is in response to a detected temperature of the fresh food storage chamber 112 that is less than the prescribed maximum temperature 252 and greater than the prescribed minimum fresh food temperature 256 along with the detected frozen food storage chamber less than the prescribed maximum 254 but greater than the prescribed minimum frozen food chamber temperature 258. The controller 128 provides signals consistent with closing the damper 158 and positioning the louvers 146 at least partially open to direct air flow from the chilled air plenum to both the fresh food and frozen food storage chambers 112, 114, respectively.

At 208, the method continues to operate under the conditions of the selected mode. Methods one and two continue until the chamber temperature causing the demand condition is reduced to be less than the prescribed maximum temperature for that chamber. Then the method enters the normal mode. The temperature in the fresh food storage chamber 112 determines the duration of operation for the normal mode. If the temperature in the fresh food storage chamber is greater than or equal to a prescribed minimum temperature 256, the normal mode continues. Once the temperature in the fresh food storage chamber 112 is less than the prescribed minimum temperature 256 for the fresh food storage chamber, the method 200 advances to 210 and the cooling cycle stops. The cooling cycle may be stopped by initiating a process to deenergize the compressor and fan. After a prescribed period, the method 200 returns to step 202 and the method reinitializes. The method 200 in a normal mode is represented in graphical form at 250.

Figure 11:
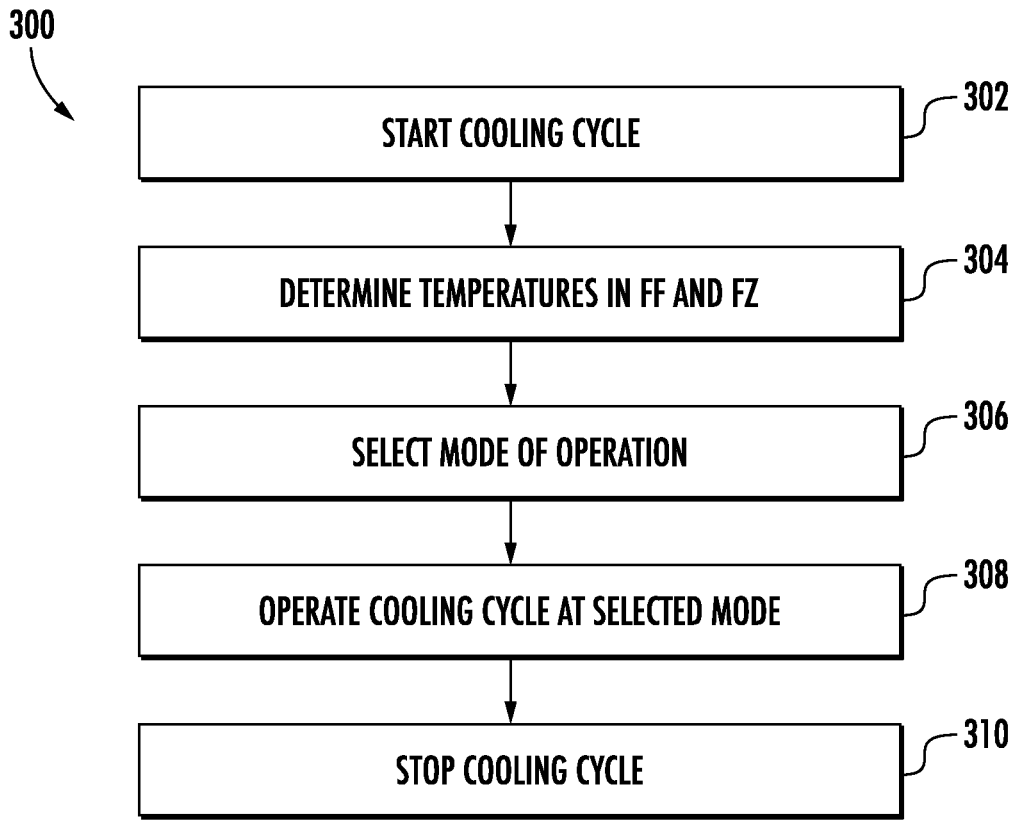
FIG. 11 illustrates a second method of operating a refrigerator appliance in a normal mode in accordance with an embodiment of the present disclosure.
Figure 11:
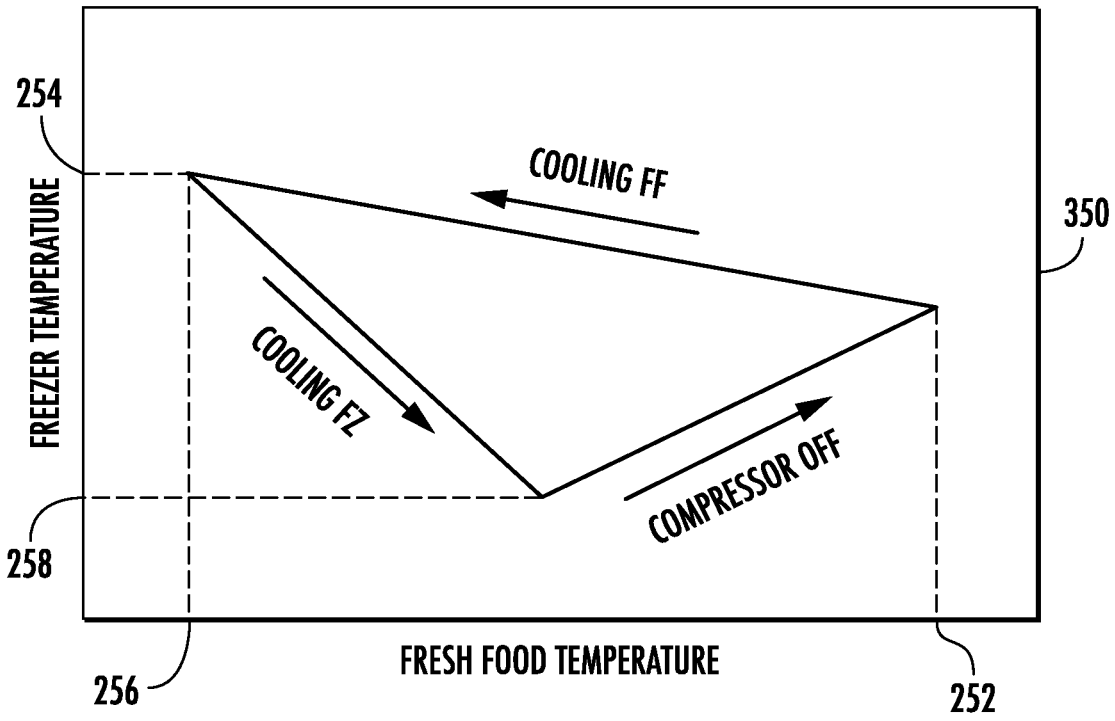

Referring now to FIG. 11, the second logic scheme sequentially cools the fresh food storage chamber 112 and the frozen food storage chamber 114 in the normal mode, starting with the fresh food storage chamber 112.

The controller 128 receives a signal from each of the temperature sensors 140, 142 corresponding to the temperature in the fresh food storage chamber 112 and the frozen food storage chamber 114, respectively, to determine if a first demand condition exists in the fresh food storage chamber 112 or a second demand condition exists in the frozen food storage chamber 114. If a first demand condition is determined in the fresh food storage chamber 112, the normal mode is enacted, cooling the fresh food storage chamber 112 first and then cooling the frozen food chamber 114. If no first demand condition is determined, the logic determines if a second demand condition exists in the frozen food storage chamber 114. If a second demand condition is determined to exist, cooling is first directed to the frozen food chamber 114 until the condition is corrected, and then the normal mode is enacted.

This logic scheme is illustrated as method 300, beginning at step 302 at which the cooling cycle begins. To start the cooling cycle, the compressor is energized to process the refrigerant and cycle the refrigerant through the sealed cooling system 130, e.g., the condenser 134 and evaporator 136. At a prescribed time, the evaporator fan 138 is energized to urge an air flow over the evaporator 136 to remove energy (heat) from the air flow and move the air into the chilled air plenum 145 and the method advances to 304.

At 304, the temperatures in the fresh food storage chamber 112 and the frozen food storage chamber 114 are determined based on input from the temperature sensors 140, 142. The method 300 advances to 306.

At 306, a mode of operation for refrigerator appliance 100 is selected from a first mode, a second, and a third mode based on the temperatures determined in 304. The first mode is called for when a temperature in the fresh food storage chamber 112 is in excess of a prescribed maximum temperature 252 in the graphical representation 350, indicating a first demand condition exists in the fresh food storage chamber 112. In response, controller 128 instructs the drive unit 170 to close louvers 146 and open the damper 158. In this configuration, all, or substantially all, of the air flow from the chilled air plenum 145 is directed to the fresh food storage chamber 112 until the first demand condition is corrected at which point the fresh food storage chamber temperature is equal to or less than the prescribed minimum fresh food storage chamber temperature 256. Once the first demand condition is corrected, the logic moves to cool the frozen food storage chamber until the prescribed minimum frozen food storage chamber temperature 258 is reached.

The second mode of operation is enacted when the frozen food storage chamber temperature is in excess of the prescribed maximum frozen food chamber temperature 254, indicating a second demand condition exists. In the second mode, the louvers 146 are open and the damper 158 is closed, directing all or substantially all of the chilled air from the plenum 145 to the frozen food storage chamber 114. This second mode continues until the prescribed minimum frozen food storage chamber temperature 258 is reached.

The third mode, corresponding to the normal mode of operation for method 300, is enacted when the temperature of the fresh food storage chamber temperature reaches the prescribed maximum 252. At that point, a controller 128 signal directs that the louvers 146 are closed and the damper 158 is open. With the louvers 146 and damper 158 thus configured, all or substantially all of the air flow from the chilled air plenum is directed to the fresh food chamber 112 until the temperature is less than or equal to the prescribed minimum temperature 256 for the fresh food storage chamber 112. Once the temperature is equal to or less than the prescribed minimum temperature, the configuration of the louvers 146 and damper 158 change to provide cooling to the frozen food storage chamber 114 only. To achieve this, the louvers 146 are open and the damper 158 is closed in accordance with a controller 128 signal. In this mode, the cooling of the frozen food storage chamber 114 continues until the temperature reaches the prescribed minimum frozen food storage chamber temperature 258.

At 308, the cooling cycle operates in the selected mode until the temperature in the frozen food storage chamber 114 is less than or equal to the prescribed minimum temperature 258. At that point, the method 300 advances to 310 and the cooling cycle stops. The cooling cycle may be stopped by initiating a process to deenergize the compressor and fan. After a prescribed period, the method 300 returns to step 302 and the method reinitializes. The method 300 in a normal mode is represented in graphical form at 350.

Figure 12:
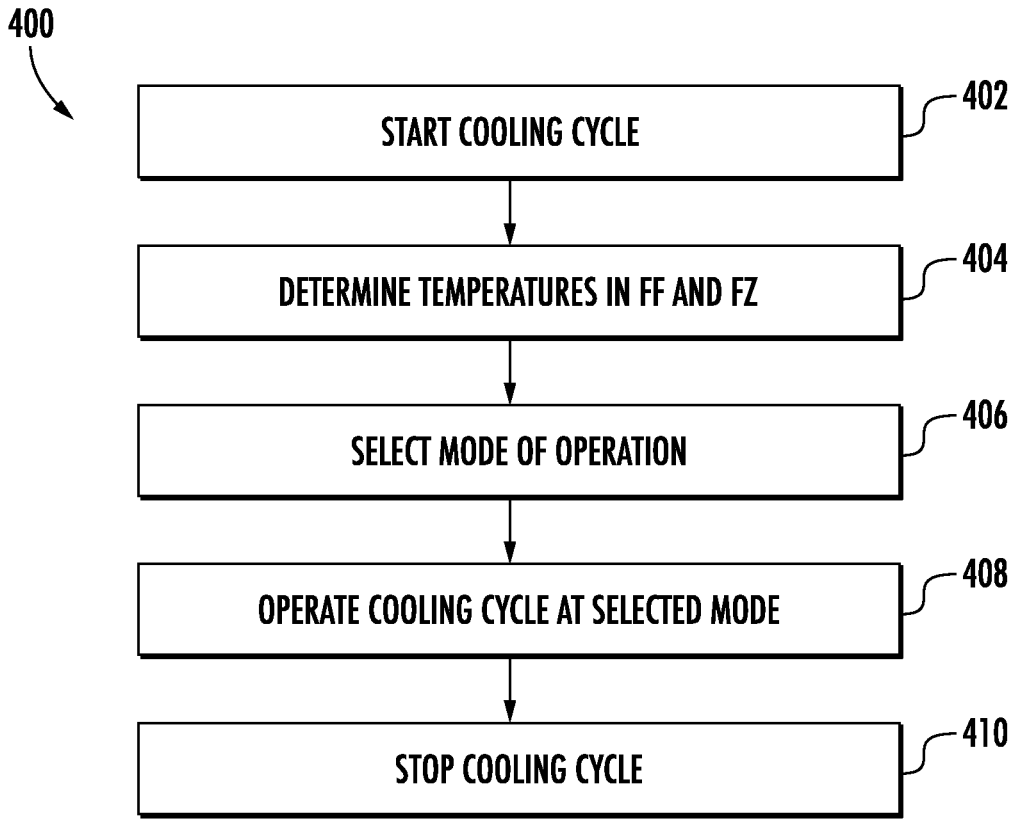
FIG. 12 illustrates a third method of operating a refrigerator appliance in a normal mode in accordance with an embodiment of the present disclosure.
Figure 12:
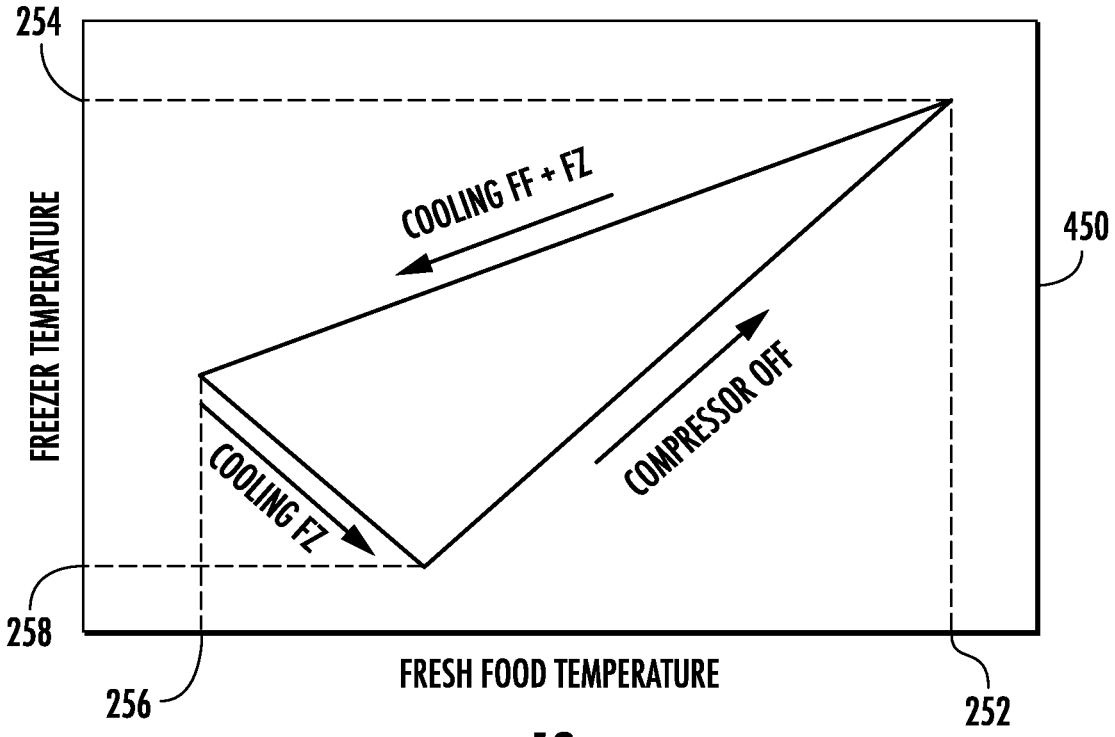

Referring now to FIG. 12, the third logic scheme provides concurrent cooling to the fresh food storage chamber and the frozen food storage chamber until a prescribed fresh food chamber minimum temperature is reached, then the frozen food storage chamber is singularly cooled.

The controller 128 receives a signal from each of the temperature sensors 140, 142 corresponding to the temperature in the fresh food storage chamber 112 and the frozen food storage chamber 114, respectively. The controller processes the signals to determine if a first demand condition in the fresh food storage chamber 112 exists or a second demand condition in the frozen food storage chamber 114 exists. If a first demand condition is determined in the fresh food storage chamber 112, a first mode begins and cools that chamber until the chamber temperature is less than the prescribed maximum temperature 252. Once the temperature in the fresh food storage chamber 112 reaches the prescribed maximum fresh food storage chamber 252, the mode begins cooling both the fresh food storage chamber 112 and the frozen food storage chamber 114 concurrently.

If the controller 128 determines a second demand condition exists in the frozen food storage chamber 114, the second mode provides chilled air to only that chamber until the condition is corrected. If the fresh food storage chamber temperature exceeds the prescribed maximum temperature 252 for that chamber before the demand condition in the frozen food chamber is corrected, the second mode stops and the third mode, the normal mode begins. In the normal mode, both the fresh food and frozen food storage chambers are provided with chilled air until the prescribed minimum fresh food storage chamber temperature 256 is reached.

This logic scheme is illustrated as method 400, beginning at step 402 at which the cooling cycle begins. To start the cooling cycle, the compressor is energized to process the refrigerant and cycle the refrigerant through the sealed cooling system 130, e.g., the condenser 134 and evaporator 136. At a prescribed time, the evaporator fan 138 is energized to urge an air flow over the evaporator 136 to remove energy (heat) from the air flow and move the air into the chilled air plenum 145 and the method advances to 404.

At 404, the temperatures in the fresh food storage chamber 112 and the frozen food storage chamber 114 are determined based on input from the temperature sensors 140, 142. The method advances to 406.

At 406, a mode of operation for refrigerator appliance 100 is selected from a first mode, a second, and a third mode based on the temperatures determined at 404. The first mode is called for when the temperature of the fresh food storage chamber 114 exceeds the prescribed maximum fresh food storage chamber temperature 252, indicating a first demand condition. In the first mode, the controller 128 sends signals consistent with closing the louvers 146 and opening damper 158 to direct all or substantially all of the chilled air from the plenum 145 to the fresh food storage chamber 112. The first mode continues until the maximum fresh food storage chamber temperature 252 is reached. At that point, controller 128 sends signals to the drive unit 170 to open the damper 158 and maintain the damper in an open position, cooling both the fresh food and frozen food storage chambers 112, 114 concurrently. Both chambers 112, 114 receive a flow of chilled air until the minimum fresh food storage chamber temperature 256 is reached. At 256, the controller sends a signal for the damper 158 to close, directing the flow of chilled air to the frozen food storage chamber 114. This flow continues until the minimum frozen food storage chamber temperature 258 is reached at which point the normal mode begins.

The second mode of operation is enacted when the frozen food storage chamber temperature is in excess of the prescribed maximum frozen food chamber temperature 254, indicating a second demand condition exists. In the second mode, the controller 128 signals the louvers 146 to open and the damper 158 to close, directing all or substantially all of the chilled air from the plenum 145 to the frozen food storage chamber 114. This second mode continues until the prescribed minimum frozen food storage chamber temperature 258 is reached at which point the normal mode begins. If the fresh food storage chamber temperature exceeds the maximum 252 before the minimum frozen food storage temperature 258 is reached, controller 128 signals for the normal mode to begin.

The third mode, corresponding to the normal mode of operation for method 400, is enacted when the temperature of the fresh food storage chamber temperature reaches the prescribed maximum 252. At that point, a controller 128 signal directs that the louvers 146 and the damper 158 are open, directing all or substantially all of the chilled air from the plenum 145 is directed to both the fresh food and frozen food storage chambers 112, 114. Both chambers 112, 114 receive a flow of chilled air until the minimum fresh food storage chamber temperature 256 is reached. At 256, the controller sends a signal for the damper 158 to close, directing the flow of chilled air to the frozen food storage chamber 114. This flow continues until the minimum frozen food storage chamber temperature 258 is reached.

At 408, the cooling cycle operates in the selected mode until the temperature in the frozen food storage chamber 114 is less than or equal to the prescribed minimum temperature 258. Once the temperature in the frozen food storage chamber 114 is less than or equal to the prescribed minimum temperature 258, the method 400 advances to 410 and the cooling cycle stops. The cooling cycle may be stopped by initiating a process to deenergize the compressor and fan. After a prescribed period, the method 400 returns to step 402 and the method reinitializes. The method 400 in a normal mode is represented in graphical form at 450.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A refrigerator appliance defining a vertical direction, a lateral direction, and a transverse direction, the vertical, lateral, and transverse directions being mutually perpendicular, the refrigerator appliance comprising: a cabinet defining a fresh food storage chamber and a frozen food storage chamber; a sealed cooling system comprising a compressor, an evaporator, and a fan, the evaporator and fan disposed in the frozen food storage chamber; a cover disposed over the evaporator and evaporator fan, the cover defining one or more open areas; louvers positioned in the one or more open areas, the louvers selectively movable between a first position and a second position; and a drive unit coupled to the louvers, wherein the drive unit rotates the louvers between the first position and the second position, a controller operatively coupled to the drive unit, wherein the drive unit selectively moves the louvers in response to signals from the controller; and wherein the louvers in the first position allow fluid communication between the evaporator fan and the frozen food storage chamber through the one or more open areas and in the second position, the louvers cooperate to block fluid communication between the evaporator fan and the frozen food storage chamber through the one or more open areas.

2. The refrigerator appliance of claim 1, wherein the fresh food storage chamber is vertically above the frozen food storage chamber.

3. The refrigerator appliance of claim 1, wherein the cover partially defines a chilled air plenum.

4. The refrigerator appliance of claim 3, wherein the chilled air plenum is fluidly coupled with the fresh food storage chamber via a supply duct.

5. The refrigerator appliance of claim 4, further comprising a return duct fluidly coupling the fresh food storage chamber with the chilled air plenum, wherein chilled air from the chilled air plenum is supplied to the fresh food storage chamber via the supply duct and return air from the fresh food storage chamber is supplied to the chilled air plenum via the return duct.

6. The refrigerator appliance of claim 4, further comprising a damper fluidly coupled to the supply duct.

7. The refrigerator appliance of claim 6, wherein the chilled air plenum is in fluid communication with the fresh food storage chamber when the damper is in a first position and fluid communication between the chilled air plenum and the fresh food storage chamber is blocked when the damper is in a second position.

8. The refrigerator appliance of claim 3, wherein the chilled air plenum is fluidly coupled with the frozen food storage chamber when the louvers are in the first position.

9. The refrigerator appliance of claim 1, wherein the drive unit rotates the louvers to intermediate positions between the first position and the second position.

10. The refrigerator appliance of claim 1, wherein the drive unit displaces the louvers, parallel to a plane of the one or more open areas, between the first position and the second position.

11. A method of operating a refrigerator appliance, the refrigerator appliance comprising a cabinet defining a fresh food storage chamber and a frozen food storage chamber, a scaled cooling system comprising compressor, an evaporator, and an evaporator fan, the evaporator and evaporator fan disposed in the frozen food storage chamber, a first, a second temperature sensor located within the frozen food storage chamber, a cover disposed over the evaporator and evaporator fan, the cover defining one or more open areas and partially defining a chilled air plenum, louvers positioned in the one or more open areas, the louvers selectively movable between a first position and a second position, a supply duct fluidly coupling the chilled air plenum with the fresh food storage chamber, a damper fluidly coupled with the supply duct, a drive unit coupled to the louvers to rotate the louvers between the first position and the second position, a controller operatively coupled to the drive unit, wherein the drive unit selectively moves the louvers in response to signals from the controller; the method comprising: starting a cooling cycle to distribute a refrigerant through the sealed cooling system; determining a temperature in the fresh food storage chamber and a temperature in the frozen food storage chamber with the first temperature sensor and the second temperature sensor, respectively, in response to starting the cooling cycle; selecting a mode of operation for the cooling cycle from a first mode, a second mode, and a third mode, in response to determining the temperature in the fresh food storage chamber and the temperature in the frozen food storage chamber, the mode of operation based on the temperature in the fresh food storage chamber and the temperature in the frozen food storage chamber, wherein-the first mode comprises closing the louvers and opening the damper, the second mode comprises opening the louvers and closing the damper, and the third mode comprises opening the louvers and opening the damper; operating the cooling cycle according to the selected mode in response to selecting the mode of operation for the cooling cycle; and stopping the cooling cycle when the temperature in the fresh food storage chamber or the frozen food storage chamber is less than a prescribed minimum temperature.

12. The method of claim 11, wherein starting the cooling cycle includes transmitting a first energization signal to the compressor corresponding to an energizing of the compressor and a second energization signal to the evaporator fan corresponding to an energizing of the evaporator fan.

13. The method of claim 12, wherein the evaporator fan urges an air flow over the evaporator.

14. The method of claim 11, wherein:

the first mode is in response to the temperature in the fresh food storage chamber in excess of a first prescribed maximum temperature; and the second mode is in response to the temperature in the frozen food storage chamber in excess of a second prescribed maximum temperature.

15. The method of claim 14, wherein the first prescribed maximum temperature is lower than the second prescribed maximum temperature.

16. The method of claim 11, wherein the drive unit displaces the louvers, parallel to a plane of the one or more open areas, between the first position and the second position.

* * * * *